US009739186B2

(12) United States Patent
Barnes

(10) Patent No.: US 9,739,186 B2
(45) Date of Patent: Aug. 22, 2017

(54) ENGINE LUBRICATION SYSTEM

(71) Applicant: CUMMINS IP, INC., Columbus, IN (US)

(72) Inventor: David M. Barnes, Columbus, IN (US)

(73) Assignee: Cummins IP, Inc., Columbus, IN (US)

( * ) Notice: Subject to any disclaimer, the term of this patent is extended or adjusted under 35 U.S.C. 154(b) by 44 days.

(21) Appl. No.: 14/760,044

(22) PCT Filed: Mar. 12, 2014

(86) PCT No.: PCT/US2014/024359

§ 371 (c)(1),
(2) Date: Jul. 9, 2015

(87) PCT Pub. No.: WO2014/165095

PCT Pub. Date: Oct. 9, 2014

(65) Prior Publication Data

US 2015/0369098 A1 Dec. 24, 2015

Related U.S. Application Data

(60) Provisional application No. 61/780,473, filed on Mar. 13, 2013.

(51) Int. Cl.

| | |
|---|---|
| ***F01M 1/00*** | (2006.01) |
| ***F01M 11/02*** | (2006.01) |
| ***F02F 1/24*** | (2006.01) |

(52) U.S. Cl.
CPC ..... *F01M 11/02* (2013.01); *F02F 1/24* (2013.01); *F01M 2011/023* (2013.01)

(58) Field of Classification Search
CPC ..... F01M 11/02; F01M 2011/023; F02F 1/24
USPC ..... 123/196 R, 90.27
See application file for complete search history.

(56) References Cited

U.S. PATENT DOCUMENTS

| | | | | |
|---|---|---|---|---|
| 1,542,765 A * | 6/1925 | Garson | F01L 7/10 123/196 R |
| 1,969,690 A | 8/1934 | Church | |
| 4,644,911 A | 2/1987 | Hidaka et al. | |
| 4,908,923 A * | 3/1990 | Anderson | F02F 7/0053 164/103 |

(Continued)

FOREIGN PATENT DOCUMENTS

| | | |
|---|---|---|
| EP | 0 525 967 | 2/1993 |

OTHER PUBLICATIONS

The Search Report and Written Opinion of the International Search Authority issued in PCT/US2014/024359, dated Jul. 15, 2014.

*Primary Examiner* — Marguerite McMahon
(74) *Attorney, Agent, or Firm* — Foley & Lardner LLP

(57) ABSTRACT

Engine lubrication systems and methods of manufacturing and implementing engine lubrication systems and methods. In particular embodiments, an engine system includes an internal combustion engine lubrication system that utilizes a stacked configuration of a through-bolted engine to pattern around through-bolts and utilizes substantially hollow bulkheads to define a central high-pressure lubrication reservoir that minimizes lube system pressure while maintaining pressure at the extremities of the lubrication circuit. Available space is utilized within the bulkheads to provide a lubrication drainage restriction for reducing lubrication losses at engine shut-down.

21 Claims, 4 Drawing Sheets

(56) References Cited

U.S. PATENT DOCUMENTS

| | | | | |
|---|---|---|---|---|
| 5,033,422 | A * | 7/1991 | Kurisu | F01L 1/053<br>123/193.5 |
| 5,954,159 | A * | 9/1999 | Nakamura | F01L 1/02<br>184/11.2 |
| 6,213,078 | B1 * | 4/2001 | Ryu | F01M 1/04<br>123/185.3 |
| 6,904,887 | B2 * | 6/2005 | Higashide | F02B 75/20<br>123/195 A |
| 6,973,902 | B2 * | 12/2005 | Okazawa | F01L 1/02<br>123/196 R |
| 7,559,299 | B2 * | 7/2009 | Brower | F02F 1/002<br>123/195 R |
| 2008/0210491 | A1 | 9/2008 | Mori et al. | |

* cited by examiner

ENGINE LUBRICATION SYSTEM

CROSS REFERENCE TO RELATED APPLICATIONS

The present application is a National Stage of PCT Patent Application No. PCT/US2014/024359, filed Mar. 12, 2014, which claims priority to U.S. Provisional Patent Application No. 61/780,473, filed Mar. 13, 2013 and entitled "ENGINE LUBRICATION SYSTEM," the contents of which are incorporated herein by reference in their entirety.

BACKGROUND

Modern internal combustion engines are designed to achieve the objectives of low weight, low cost, and high efficiency. Often, these objectives compete with each other such that meeting one objective can result in the failure to meet another objective. For example, modern engine designers aim to achieve a high efficiency engine by increasing the peak cylinder pressure (PCP) capability of the engine. However, in view of the high forces generated by high PCP that are placed on the components of the engine, stronger materials and/or greater mass of materials are required. In most cases, stronger materials also are heavier. Therefore, it is difficult for modern engines to be highly efficient, while also being lightweight. Additionally, lightweight materials such as aluminum tend to have relatively poor fatigue strength, which further limits its viability in high PCP engines.

In view of the above constraints, some engines attempt to avoid the fatigue associated with lighter materials by utilizing a through-bolt scheme that maintains a block made from a lightweight material in compression. However, conventional through-bolt schemes are not conducive to many internal engine lubrication arrangements. For example, the positioning of through-bolts through cylinder blocks generally traverses normal lubrication distribution channels and may block or impede the flow of lubrication through those channels to important components of the engine, such as the main crankshaft journal.

Additionally, typical internal lubrication arrangements for common internal combustion engines tend to result in parasitic losses in the lubrication pump due to high pump-out pressure required to maintain lubrication pressure at the extremities of the lubrication circuit. Moreover, many internal lubrication schemes result in substantial draining of lubrication from the lubrication circuit upon engine shutdown, which causes lubrication shortages and lubrication priming delays within the engine upon start-up.

SUMMARY

Various embodiments provide engine lubrication systems and methods of manufacturing and implementing engine lubrication systems and methods. In particular embodiments, an engine system of the present disclosure includes an internal combustion engine lubrication system that utilizes a stacked configuration of a through-bolted engine to pattern around through-bolts and utilizes substantially hollow bulkheads to define a central high-pressure lubrication reservoir that minimizes lube system pressure while maintaining pressure at the extremities of the lubrication circuit. Available space is utilized within the bulkheads to provide a lubrication drainage restriction for reducing lubrication losses at engine shut-down.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings.

The subject matter of the present application has been developed in response to the present state of the art, and in particular, in response to the problems and needs in the internal combustion engine art that have not yet been fully solved by currently available systems. More specifically, in some embodiments, the engine system of the present disclosure includes an internal combustion engine lubrication system that utilizes a stacked configuration of a through-bolted engine to pattern around through-bolts and utilizes substantially hollow bulkheads to define a central high-pressure lubrication reservoir that minimizes lube system pressure while maintaining pressure at the extremities of the lubrication circuit, and utilizes available space within the bulkheads to provide a lubrication drainage restriction for reducing lubrication losses at engine shut-down.

Figure 1:
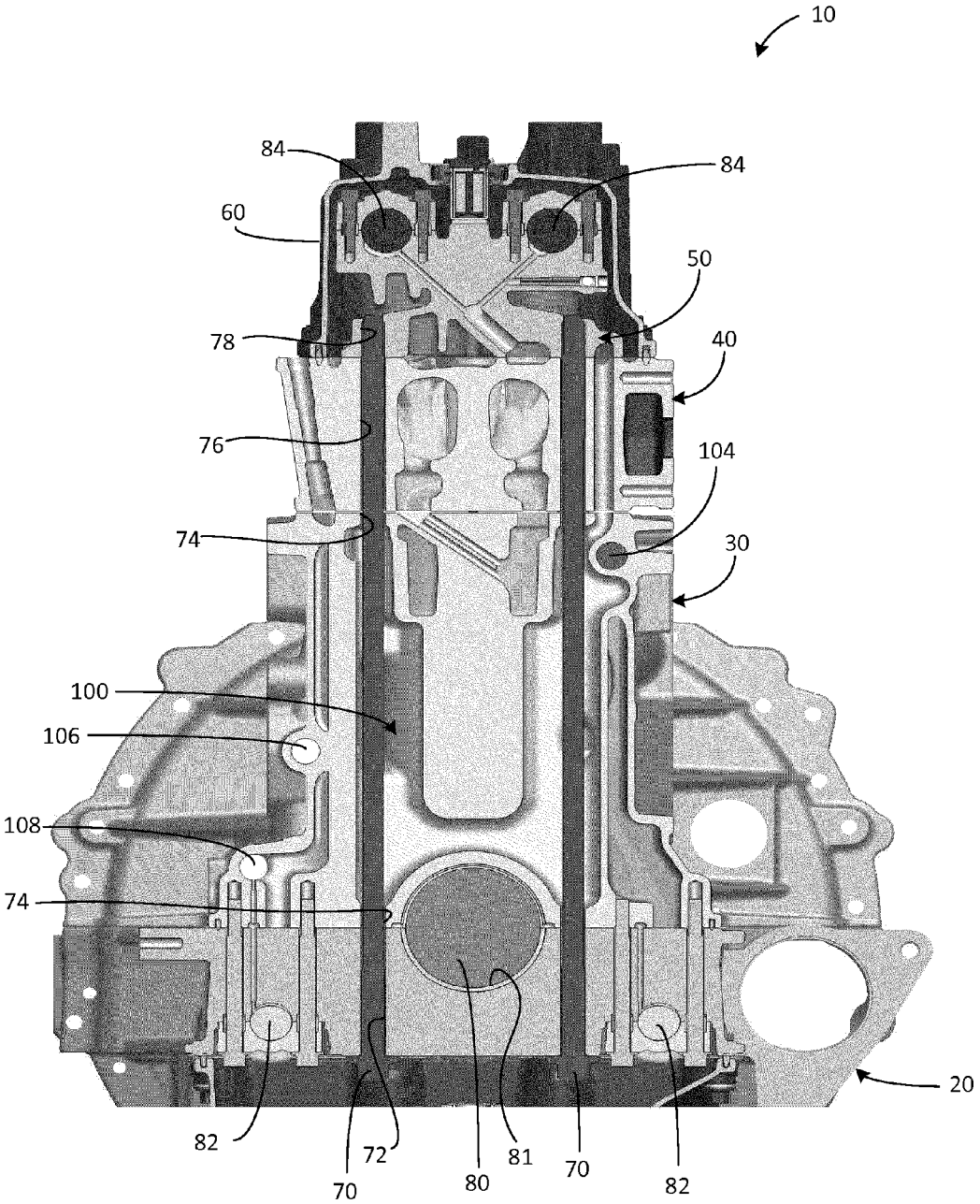
FIG. 1 illustrates a cross sectional view of an internal combustion according to one embodiment of the present disclosure.

Referring to FIG. 1, one embodiment of an internal combustion engine 10 includes a stacked arrangement of components. For example, as shown, the engine 10 includes a base 20, block 30, cylinder head 40, cam carrier 50, and cover 60. The block 30 is mounted directly onto the base 20, which can be defined as a bed plate. The cylinder head 40 is mounted directly onto the block 30, and the cam carrier 50 is mounted directly onto the cylinder head 40. Lastly, the cover 60 is positioned over the cam carrier 50 and secured to the cylinder head 40. In some implementations, a relatively thin sealing gasket may be positioned between one or more of the base 20, block 30, cylinder head 40, cam carrier 50, and cover 60. As defined herein, in view of the relative thinness of the gasket, one component is still considered directly mounted onto another component with a gasket positioned therebetween.

The base 20 and cam carrier 50 are made from a high-strength material, such as iron or steel, using any of various manufacturing techniques, such as machining and casting. In contrast, the block 30 and cylinder head 40 are made from a lightweight material, such as aluminum, using any of various manufacturing techniques, such as machining and casting. In this manner, the components made from lightweight materials are effectively sandwiched between the components made from high-strength materials. The base 20, block 30, cylinder head 40, and cam carrier 50 are secured together by a plurality of through-bolts 70 extending through respective apertures 72, 74, 76, 78 of the base, block, cylinder head, and cam carrier. In the illustrated embodiment, the head of the bolt 70 is position against the base 20 and the opposing end of the shank of the bolt is engaged in the aperture 78 of the cam carrier 50. Alternatively, the head of the bolt 70 can be positioned against the cam carrier 50 and the opposing end of the shank of the bolt can be engaged in the aperture 72 of the base 20. In either configuration, tightening of the bolt 70 tightens the base 20 and cam carrier 50 against the block 30 and cylinder head.

In this manner, the block 30 and cylinder head 40 are maintained in compression throughout the entire operational range of the engine 10. Additionally, each through-bolt 70 is positioned to extend through a hollow interior of a respective bulkhead formed in the block 30. Each bulkhead of the engine 10 can be defined as the partition formed in the block 30 that divides or separates the combustion cylinders of the engine.

The engine 10 includes various other features necessary for operation of the engine. For example, the engine 10 includes a crankshaft positioned between the base 20 and block 30 with a plurality of main journals 80 of the crankshaft positioned within a main journal receiving space 81 defined between opposing semi-circular shaped recesses formed in the base and block. Additionally, the engine 10 may include balance shafts with one or more journals 82 positioned within the base 20. Further, although not shown, the engine 10 includes a plurality of pistons movable within respective combustion cylinders between the bulkheads.

Figure 3:
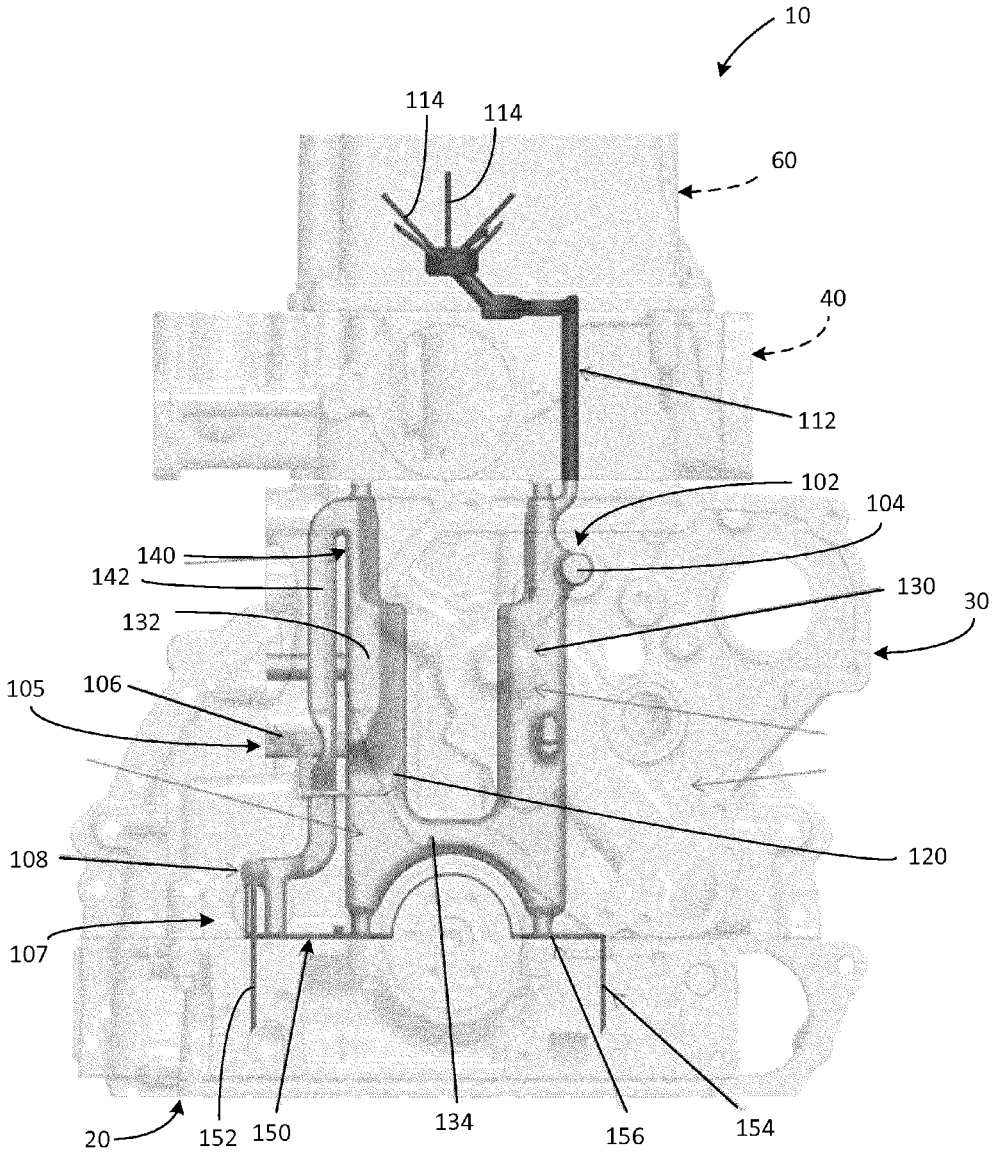
FIG. 3 is a partially transparent end view of the internal combustion engine of FIG. 1.

The engine 10 includes a lubrication system 100 that includes a plurality of fluid channels and reservoirs for transmitting and storing a lubricant. In some implementations, the lubricant is oil. The lubrication system 100 includes a central high-pressure lubrication reservoir 102 formed in a central location within the block 30, which in some implementations is a middle bulkhead of the block approximately midway between front and rear ends of the block. The reservoir 102 is a substantially upright member that has an intake section 130 on an intake side of the engine 10, an exhaust section 132 on an exhaust side of the engine, and a bridge section 134 fluidly coupling the intake section and exhaust section (see, e.g., FIG. 3). As shown in FIG. 3, the reservoir 102 has a substantially U-shaped cross-section. The casting process available for manufacturing the block 30 and the reservoir 102 allows for the formation of a substantially non-round, unique shape for the reservoir. Each of the intake section 130 and exhaust section 132 extends from a bottom of the block 30 proximate the base 20 upwardly to a top of the block proximate the cylinder head 40. The bridge section 134 fluidly couples bottom portions of the intake and exhaust sections 130, 132, and may extend about a middle one of the main journals 80.

In operation (e.g., when the engine is powered on), the reservoir 102 contains a volume of lubrication maintained at a relatively high pressure. High pressure lubrication from a lubrication source is supplied to the reservoir 102 via a supply line 104 formed in the block 30. The reservoir 102 is fluidly coupled to first, second, and third lubrication circuits 105, 107, 109, respectively, formed in one, two, or more of the base 20, block 30, cylinder head 40 and cam carrier 50.

The first lubrication circuit 105 is formed in the block 30 and includes a first rifle or main conduit 106 extending in a front-to-rear direction (e.g., parallel to the crankshaft). In operation, the first rifle 106 contains high pressure lubricant received from the reservoir 102. The first rifle 106 receives lubricant from the reservoir 102 at an approximate end-to-end midpoint on the first rifle. In this manner, the restriction of flow through the first rifle 106 is minimized by minimizing the length of rifle 106 the lubricant must flow through. Accordingly, pressure losses within the first lubrication circuit 105 are reduced. The first lubrication circuit 105 also includes a plurality of smaller delivery conduits 120 each formed in the block 30 and positioned adjacent a respective piston cooling nozzle (PCN) location. As lubrication is supplied to the first rifle 106 from the reservoir 102, lubrication in the delivery conduits 120 is supplied to a respective PCN to cool the piston. The first lubrication circuit 105 may include a check valve that is actuatable to retain lubrication within the circuit 105 after shut-down of the engine 10.

The second lubrication circuit 107 is formed in the base 20 and block 30 and includes a second rifle or main conduit 108 extending in a front-to-rear direction. In operation, the second rifle 108 contains high pressure lubricant received from the reservoir 102 via a drainage arm 142 of a lubricant dam 140 of the reservoir 102 as will be explained below. The second rifle 108 receives lubricant from the reservoir 102 at an approximate end-to-end midpoint on the second rifle. In this manner, the restriction of flow through the second rifle 108 is minimized by minimizing the length of rifle 108 the lubricant must flow through. Accordingly, pressure losses within the second lubrication circuit 107 are reduced.

Figure 2:
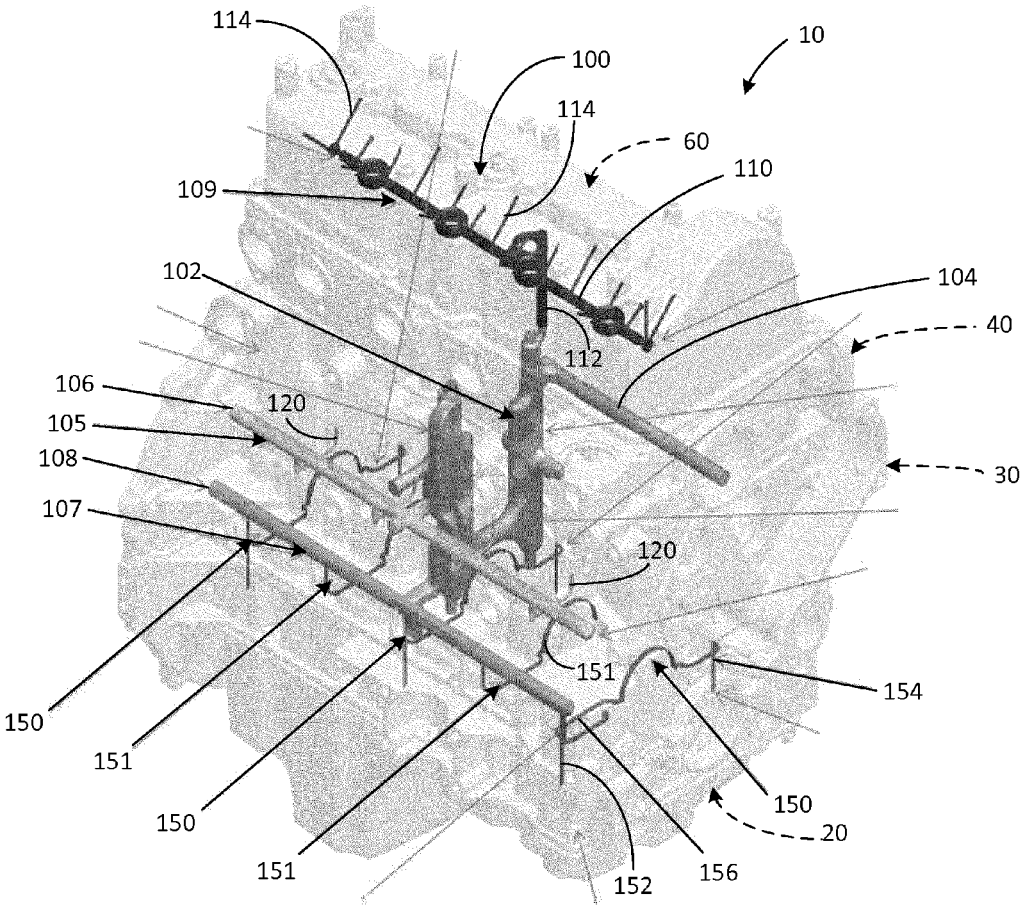
FIG. 2 is a partially transparent perspective of the internal combustion engine of FIG. 1.

Like the first lubrication circuit 105, the second lubrication circuit 107 also includes a plurality of smaller delivery conduits 150, 151 each formed partially in the block 30 and partially in the base 20. Each delivery conduit 150 is positioned adjacent a respective main journal 80 of the crankshaft, and each delivery conduit 151 is positioned adjacent a respective portion of the crankshaft coupled to a connecting rod. Each of the delivery conduits 150 includes a first balance shaft journal portion 152 that extends substantially vertically downward to lubricate an intake side balance shaft journal 82, and a second balance shaft journal portion 154 that extends substantially vertically downward to lubricate an exhaust side balance shaft journal 82. While the delivery conduits 151 do not include balance shaft journal portions, each delivery conduit 150, 151 does include a bridging portion 156 that extends substantially laterally across the engine 10 from the intake side to the exhaust side (e.g., across a side-to-side mid-plane of the engine). As shown in FIG. 2, the bridging portions 156 follow a circuitous path around the through-bolts 72. In this manner, the bolts 72 do not obstruct the ability to transport lubrication laterally across the engine for lubricating the main journal 80. A section of the bridging portion 156 of the fluid conduits 150 wraps around the main journal 80 and is fluidly open to the main journal receiving space 81 to lubricate the journal. In contrast, a section of the bridging portion 156 of the fluid conduits 151 wraps around and is open to the crankshaft and a respective connecting rod to lubricate the same.

Figure 4:
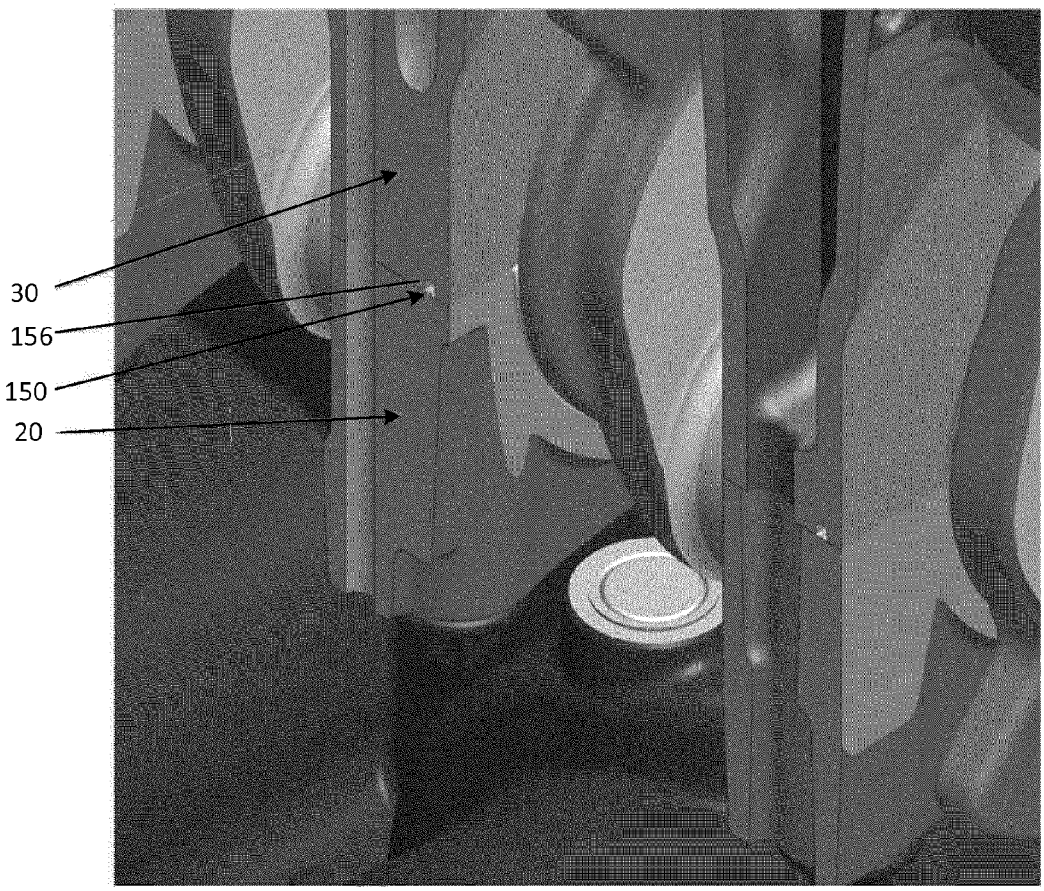
FIG. 4 is a cross-sectional perspective view of two substantially hollow bulkheads of the internal combustion engine of FIG. 1.

Referring to FIG. 4, which is a cross-sectional perspective view of two substantially hollow bulkheads of the engine 10. As shown, the bridging portion 156 of the delivery conduits 150 are defined between channels or grooves formed in the bottom surface of the block 30 at a bulkhead and the flat upper surface of the base 20 under the bulkhead. The casting technique used to make the block 30 is conducive to the formation of groves in the block 30. Configuring the bridging portions 156 in this manner promotes the ability to maneuver the bridging portions around the pass-through bolts 70.

The third lubrication circuit 109 is formed in the cylinder head 40 and cam carrier 50, and includes a third rifle or main conduit 110 extending in a front-to-rear direction. The third rifle 110 is formed in the cam carrier 50. In operation, the third rifle 110 contains high pressure lubricant received from the reservoir 102 via an upright supply line 112 that is fluidly coupled to the reservoir. The third rifle 110 receives lubricant from the reservoir 102 at an approximate end-to-end midpoint on the second rifle. In this manner, the restriction of flow through the third rifle 110 is minimized by minimizing the length of rifle 110 the lubricant must flow through. In this manner, pressure losses within the third lubrication circuit 109 are reduced. Like the first and second lubrication circuits 105, 107, the third lubrication circuit 109 also includes a plurality of smaller delivery conduits 114 each formed in the cam carrier 50. Each delivery conduit 114 is positioned adjacent a respective valve cam journal 84. As lubrication is supplied to the third rifle 110 from the reservoir 102, lubrication in the delivery conduits 114 is supplied to a valve cam journal to lubricate the journals of the overhead cam shafts.

As high pressure lubrication is supplied to the reservoir 102 from the supply line 104, and the reservoir 102 becomes filled with high pressure lubricant, lubricant is supplied to the first, second, and third rifles 106, 108, 110, and the associated delivery conduits, from the reservoir 102. The lubricant dam 140 of the reservoir 102 is uniquely configured to prevent a complete drainage of lubricant from the reservoir after a shut-down of the engine 10. In order for the second rifle 108 to receive lubricant from the reservoir 102, the lubricant in the reservoir must reach the upper end of the exhaust section 132 of the reservoir to pass over the dam 140 and flow into and fill the drainage arm 142. During the lubrication process, lubricant effectively leaks out of the delivery conduits 150 without a check valve in place to prevent such leakage. However, as long as the lubrication reservoir 102 is supplied with high pressure lubrication (e.g., while the engine is running after start-up), the drainage arm 142 is continuously filled with fresh lubrication. But, when the supply of high pressure lubrication to the reservoir 102 stops when the engine is shut down or stops running, there is no fresh supply of lubrication to replace the lubrication lost from the delivery conduits 150. Accordingly, lubrication slowly drains or leaks out of the delivery conduits 150, second rifle 108, and drainage arm 142 until the second circuit 107 is effectively emptied of lubrication.

Because the placement of the dam 140 at a high point on the exhaust section 132 of the reservoir 102, although lubrication drains from the drainage arm 142, such drainage does not affect or drain the lubrication in the reservoir 102. In this manner, upon a subsequent start-up of the engine 10, only enough high pressure lubrication to fill the drainage arm 142 and second circuit 107 is required to fully pressurize the lubrication system, as opposed to the entire reservoir and all three lubrication circuits 105, 107, 109. Such a configuration leads to faster pressurization or priming of the lubrication system and more responsive lubrication of the engine's components upon start-up of the engine compared to conventional lubrication systems.

The described features, structures, advantages, and/or characteristics of the subject matter of the present disclosure may be combined in any suitable manner in one or more embodiments and/or implementations. In the above description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the above description and appended claims, or may be learned by the practice of the subject matter as set forth above.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An internal combustion engine, comprising:

a base including an upper surface;

a cylinder block mounted to the upper surface of the base via a lower surface of the cylinder block, the cylinder block including a reservoir disposed in a central location within the cylinder block;

a cylinder head coupled to cylinder block;

a cam carrier coupled to the cylinder head, such that the cylinder head is positioned between the cylinder block and the cam carrier, wherein the base, the cylinder block, the cylinder head, and the cam carrier form a plurality of through-bolt openings, each through-bolt opening in the plurality of through bolt openings extending from the base to the cam carrier through the cylinder block and the cylinder head, and a plurality of lubrication circuits positioned in at least one of the base, the cylinder block, the cylinder head and the cam carrier, the plurality of lubrication circuits fluidly coupled to the reservoir, the plurality of lubrication circuits fluidly decoupled from the plurality of through bolt openings.

2. The internal combustion engine of claim 1, wherein each through-bolt opening in the plurality of through-bolt openings includes a threaded formation in at least one of the base and cam carrier.

3. The internal combustion engine of claim 1, wherein the cylinder block and cylinder head comprise aluminum and, wherein the base and the cam carrier comprise at least one of iron and steel.

4. The internal combustion engine of claim 1, further comprising a plurality of delivery circuits extending from at least one lubrication circuit of the plurality of lubrication circuits to a plurality of journal openings in the base, each journal opening configured to receive a crankshaft journal.

5. The internal combustion engine of claim 4, wherein at least one of the delivery circuits in the plurality of delivery circuits is formed between the base and the cylinder block by a channel disposed in one of the upper surface of the base and the lower surface of the cylinder block.

6. The internal combustion engine of claim 1, wherein the plurality of delivery circuits extend along a path around the plurality of through-bolt openings such that the plurality of delivery circuits are fluidly decoupled from the plurality of through-bolt openings.

7. The internal combustion engine of claim 1, wherein the plurality of lubrication circuits includes at least one lubrication circuit in the cylinder block and at least one lubrication circuit in the cylinder head.

8. The internal combustion engine of claim 1, wherein at least one lubrication circuit in the plurality of lubrication circuits includes a check-valve.

9. An internal combustion engine, comprising:

a base including an upper surface;

a cylinder block mounted to the upper surface of the base via a lower surface of the cylinder block, the cylinder block including a reservoir disposed therein;

a cylinder head coupled to cylinder block;

a cam carrier coupled to the cylinder head, such that the cylinder head is positioned between the cylinder block and the cam carrier, wherein the base, the cylinder block, the cylinder head, and the cam carrier form a plurality of through-bolt openings, each through-bolt opening in the plurality of through bolt openings extending from the base to the cam carrier through the cylinder block and the cylinder head, and a plurality of lubrication circuits positioned in at least one of the base, the cylinder block, the cylinder head and the cam carrier, the plurality of lubrication circuits fluidly coupled to the reservoir, the plurality of lubrication circuits fluidly decoupled from the plurality of through bolt openings, wherein each lubrication circuit of the plurality of lubrication circuits is fluidly coupled to the reservoir at a midpoint of the respective lubrication circuit.

10. An internal combustion engine, comprising:

a base including an upper surface;

a cylinder block mounted to the upper surface of the base via a lower surface of the cylinder block, the cylinder block including a reservoir disposed therein;

a cylinder head coupled to cylinder block;

a cam carrier coupled to the cylinder head, such that the cylinder head is positioned between the cylinder block and the cam carrier, wherein the base, the cylinder block, the cylinder head, and the cam carrier form a plurality of through-bolt openings, each through-bolt opening in the plurality of through bolt openings extending from the base to the cam carrier through the cylinder block and the cylinder head, and a plurality of lubrication circuits positioned in at least one of the base, the cylinder block, the cylinder head and the cam carrier, the plurality of lubrication circuits fluidly coupled to the reservoir, the plurality of lubrication circuits fluidly decoupled from the plurality of through bolt openings, wherein the reservoir is a u-shaped reservoir extending from an intake section of the internal combustion engine to an exhaust section of the internal combustion engine.

11. The internal combustion engine of claim 10, wherein the u-shaped reservoir includes a dam positioned in one branch thereof, the dam positioned between the reservoir and at least one lubrication circuit of the plurality of lubrication circuits.

12. A method of lubricating an internal combustion engine, comprising:

receiving a lubricant in a reservoir disposed in a central location within a cylinder block of the internal combustion engine, the cylinder block mounted to an upper surface of a base via a lower surface of the cylinder block, the cylinder block including a cylinder head, the cylinder head having a cam carrier coupled to the cylinder head such that the cylinder head is positioned between the cylinder block and the cam carrier, wherein the base, the cylinder block, the cylinder head, and the cam carrier form a plurality of through-bolt openings, each through-bolt opening extending from the base to the cam carrier through the cylinder block and the cylinder head; and causing the lubricant to flow from the reservoir to a plurality of lubrication circuits positioned in at least one of the base, the cylinder block, the cylinder head and the cam carrier, the plurality of lubrication circuits being in fluid isolation from the plurality of through-bolt openings.

13. The method of lubricating an internal combustion engine of claim 12, further comprising delivering the lubricant from the reservoir to the lubrication circuits via a plurality of delivery circuits.

14. The method of lubricating an internal combustion engine of claim 12, further comprising delivering the lubricant from at least one lubrication circuit in the plurality of lubrication circuits to a plurality of journal openings in the base via a plurality of delivery circuits extending from the at least one lubrication circuit, each journal opening configured to receive a crankshaft journal.

15. The method of lubricating an internal combustion engine of claim 14, wherein at least one of the delivery circuits in the plurality of delivery circuits is formed between the base and the cylinder block by a channel disposed in one of the upper surface of the base and the lower surface of the cylinder block.

16. The method of lubricating an internal combustion engine of claim 15, wherein the plurality of delivery circuits extend along a path around the plurality of through-bolt openings such that the plurality of delivery circuits are fluidly decoupled from the plurality of through-bolt openings.

17. The method of lubricating an internal combustion engine of claim 12, wherein the cylinder block and cylinder head comprise aluminum, and wherein the base and the cam carrier comprise at least one of iron and steel.

18. The method of lubricating an internal combustion engine of claim 12, wherein at least one lubrication circuit in the plurality of lubrication circuits includes a check-valve.

19. A method of lubricating an internal combustion engine, comprising:

receiving a lubricant in a reservoir disposed in a cylinder block of the internal combustion engine, the cylinder block mounted to an upper surface of a base via a lower surface of the cylinder block, the cylinder block including a cylinder head, the cylinder head having a cam carrier coupled to the cylinder head such that the cylinder head is positioned between the cylinder block and the cam carrier, wherein the base, the cylinder block, the cylinder head, and the cam carrier form a plurality of through-bolt openings; and causing the lubricant to flow from the reservoir to a plurality of lubrication circuits in fluid isolation from the plurality of through-bolt openings, wherein each lubrication circuit of the plurality of lubrication circuits is fluidly coupled to the reservoir at a midpoint of the respective lubrication circuit.

20. A method of lubricating an internal combustion engine, comprising:

receiving a lubricant in a reservoir disposed in a cylinder block of the internal combustion engine, the cylinder block mounted to an upper surface of a base via a lower surface of the cylinder block, the cylinder block including a cylinder head, the cylinder head having a cam carrier coupled to the cylinder head such that the cylinder head is positioned between the cylinder block and the cam carrier, wherein the base, the cylinder block, the cylinder head, and the cam carrier form a plurality of through-bolt openings; and causing the lubricant to flow from the reservoir to a plurality of lubrication circuits in fluid isolation from the plurality of through-bolt openings, wherein the reservoir is a u-shaped reservoir extending from an intake section of the internal combustion engine to an exhaust section of the internal combustion engine.

21. A method of lubricating an internal combustion engine, comprising:

receiving a lubricant in a reservoir disposed in a cylinder block of the internal combustion engine, the cylinder block mounted to an upper surface of a base via a lower surface of the cylinder block, the cylinder block including a cylinder head, the cylinder head having a cam carrier coupled to the cylinder head such that the cylinder head is positioned between the cylinder block and the cam carrier, wherein the base, the cylinder block, the cylinder head, and the cam carrier form a plurality of through-bolt openings; and causing the lubricant to flow from the reservoir to a plurality of lubrication circuits in fluid isolation from the plurality of through-bolt openings wherein the u-shaped reservoir includes a dam positioned in one branch thereof, the dam positioned between the reservoir and at least one lubrication circuit in the plurality of lubrication circuits.

* * * * *